US009175524B2

(12) United States Patent
Leman et al.

(10) Patent No.: US 9,175,524 B2
(45) Date of Patent: Nov. 3, 2015

(54) PIPE DRIVE SEALING SYSTEM AND METHOD

(75) Inventors: Michael Everett Leman, Humble, TX (US); Thomas George Roesner, Katy, TX (US)

(73) Assignee: TESCO CORPORATION, Houston, TX (US)

( * ) Notice: Subject to any disclaimer, the term of this patent is extended or adjusted under 35 U.S.C. 154(b) by 895 days.

(21) Appl. No.: 13/339,161

(22) Filed: Dec. 28, 2011

(65) Prior Publication Data

US 2013/0168105 A1 Jul. 4, 2013

(51) Int. Cl.

| | |
|---|---|
| ***E21B 19/00*** | (2006.01) |
| ***E21B 17/03*** | (2006.01) |
| ***E21B 19/08*** | (2006.01) |
| ***E21B 19/16*** | (2006.01) |

(52) U.S. Cl.
CPC ..... *E21B 17/03* (2013.01); *E21B 19/08* (2013.01); *E21B 19/16* (2013.01)

(58) Field of Classification Search
CPC ..... E21B 19/165; E21B 19/08
USPC ..... 166/242.6, 377, 378, 379; 175/162, 175/202, 203
See application file for complete search history.

(56) References Cited

U.S. PATENT DOCUMENTS

| | | | | |
|---|---|---|---|---|
| 4,867,236 | A | 9/1989 | Haney et al. | |
| 5,036,927 | A | 8/1991 | Willis | |
| 5,441,310 | A * | 8/1995 | Barrett et al. | 285/18 |
| 6,311,792 | B1 | 11/2001 | Scott et al. | |
| 7,543,650 | B2 * | 6/2009 | Richardson | 166/379 |
| 7,770,654 | B2 | 8/2010 | Beierbach et al. | |
| 7,854,265 | B2 | 12/2010 | Zimmermann | |
| 2004/0256871 | A1 | 12/2004 | Leman et al. | |

FOREIGN PATENT DOCUMENTS

| | | |
|---|---|---|
| GB | 2378199 | 2/2003 |

OTHER PUBLICATIONS

International Search Report and Written Opinion for International Application No. PCT/US2012/067449, mailed Jan. 27, 2014.
Warren Schneider, Casing Drive System drives safety, efficiency, E&P, Jan. 1, 2007.
Tesco Casing Drive System, Tesco Corporation, 2011.

* cited by examiner

*Primary Examiner* — Giovanna C Wright
(74) *Attorney, Agent, or Firm* — Fletcher Yoder, P.C.

(57) ABSTRACT

Present embodiments are directed to a gripping device configured to cooperate with a pipe drive system or top drive to provide a sealed engagement with drillpipe elements. The gripping device includes a housing configured to extend over and at least partially around a distal end of the drillpipe element. Further, the gripping device includes a seal area positioned along an inner perimeter of the housing such that, when a seal is inserted in the seal area, the seal is arranged to engage with a face of the distal end of the drillpipe element and a face of the gripping device. Further, the gripping device includes engagement features configured to extend inwardly from the inner perimeter to facilitate coupling of the gripping device with an outer circumferential area of the drillpipe element.

20 Claims, 3 Drawing Sheets

PIPE DRIVE SEALING SYSTEM AND METHOD

BACKGROUND

Present embodiments relate generally to the field of drilling and processing of wells, and, more particularly, to a pipe drive system for coupling with and releasing drillpipe elements to facilitate insertion and removal of the drillpipe elements into and out of a wellbore during drilling operations and the like.

In conventional oil and gas operations, a drilling rig is used to drill a wellbore to a desired depth using a drill string, which includes drillpipe, drill collars and a bottom hole drilling assembly. During drilling, the drill string may be turned by a rotary table and kelly assembly or by a top drive to facilitate the act of drilling. As the drill string progresses down hole, additional drillpipe is added to the drill string.

During drilling of the well, the drilling rig may be used to insert joints or stands (e.g., multiple coupled joints) of drillpipe into the wellbore. Similarly, the drilling rig may be used to remove drillpipe from the wellbore. As an example, during insertion of drillpipe into the wellbore by a traditional operation, each drillpipe element (e.g., each joint or stand) is coupled to an attachment feature that is in turn lifted by a traveling block of the drilling rig such that the drillpipe element is positioned over the wellbore. An initial drillpipe element may be positioned in the wellbore and held in place by gripping devices near the rig floor, such as slips. Subsequent drillpipe elements may then be coupled to the existing drillpipe elements in the wellbore to continue formation of the drill string. Once attached, the drillpipe element and remaining drill string may be held in place by an elevator and released from the gripping devices (e.g., slips) such that the drill string can be lowered into the wellbore. Once the drill string is in place, the gripping devices can be reengaged to hold the drill string such that the elevator can be released and the process of attaching drillpipe elements can be started again. Similar procedures may be utilized for removing drillpipe from the wellbore.

Drillpipe is traditionally controlled during drilling using a screwed-in sub below the quill of a top drive. It is now recognized that certain aspects of these existing techniques are inefficient because of limitations on other procedural components during certain phases of operation.

BRIEF DESCRIPTION

In accordance with one aspect of the invention, a pipe drive system is provided. The pipe drive system includes a gripping device configured to engage a drillpipe element and a top drive configured to impart rotational force to the gripping device. Additionally, the system includes a housing of the gripping device configured to extend over and at least partially around a distal end of the drillpipe element. Further, the system includes a seal area positioned along an inner perimeter of the housing such that, when a seal is inserted in the seal area, the seal is arranged to engage with a face of the distal end of the drillpipe element and a face of the gripping device. Further still, the system includes engagement features of the gripping device configured to extend inwardly from the inner perimeter to facilitate coupling of the gripping device with an outer circumferential area of the drillpipe element.

In accordance with one aspect of the invention, a gripping device is provided. The gripping device includes a housing including a receptacle, wherein the receptacle includes a receptacle face and a receptacle boundary extending from a perimeter of the receptacle face. Additionally, the gripping device includes an engagement feature coupled with the housing and configured to be actuated to engage an outer circumferential area of a drillpipe element when the housing is extending over a distal end of the drillpipe element. Further, the gripping device includes a seal positioned within an inner boundary of the housing, wherein the seal is arranged to engage with a drillpipe face of the distal end of the drillpipe element and the receptacle face within the housing.

In accordance with one aspect of the invention, a method of assembling or disassembling a drill string is provided. The method includes extending a housing of a gripping device over a distal end of a drillpipe element such that a boundary of the housing extending from a perimeter of a face of the gripping device surrounds a circumferential area of the drillpipe element. Additionally, the method includes pressing a seal between the face of the gripping device and a face of the drillpipe element. Further, the method includes engaging the circumferential area of the drillpipe element with an engagement feature of the gripping device.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
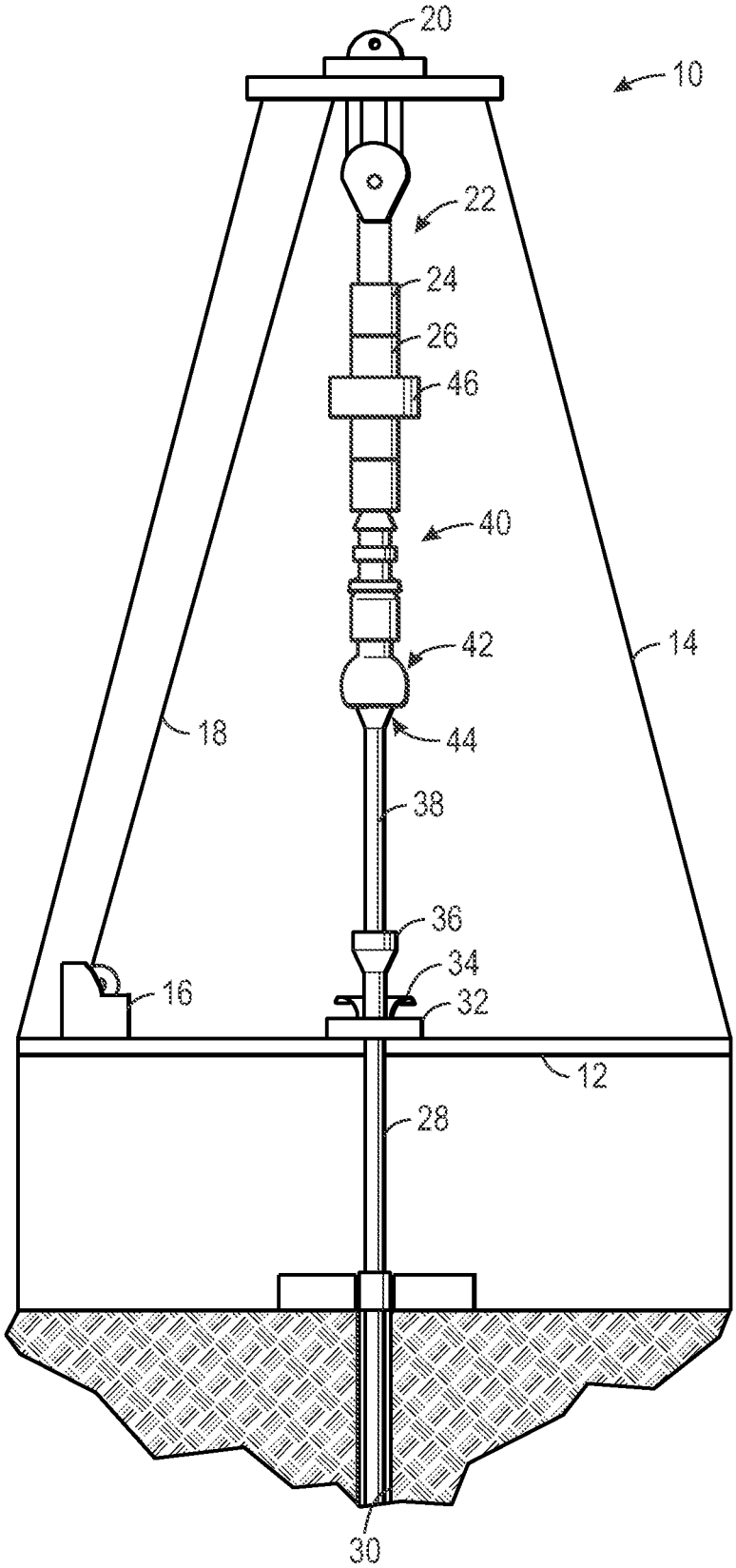
FIG. 1 is a schematic of a well being drilled in accordance with present techniques.

Present embodiments are directed to systems and methods for facilitating sealed engagement between drillpipe handling equipment (e.g., pipe drive systems or top drive systems) and drillpipe elements (e.g., joints or strings of drillpipe). For example, present embodiments include a gripping device that is integral with or configured to be coupled with a pipe drive system. A pipe drive system in accordance with present techniques may be used to facilitate assembly and disassembly of drill strings. Indeed, a pipe drive system may be employed to engage and lift a drillpipe element (e.g., a drillpipe joint), align the drillpipe element with a drill string, stab a pin end of the drillpipe element into a box end of the drill string, engage the drill string, and apply torque to make-up a coupling between the drillpipe element and the drill string. Thus, a pipe drive system may be employed to extend the drill string. Similarly, the pipe drive system may be used to disassemble drillpipe elements from a drill string by applying reverse torque and lifting the drillpipe elements out of the engagement with the remaining drill string. It should be noted that torque may be applied using a top drive system coupled to the pipe drive system or integral with the pipe drive system.

Each drillpipe element typically includes a pin end and a box end to facilitate coupling of multiple joints of drillpipe.

When positioning and assembling drillpipe elements in the wellbore, a drillpipe element is typically inserted into the wellbore until only an upper end is exposed above the wellbore. This exposed portion may be referred to as a stump. At this point, slips are typically positioned about the stump near the rig floor to hold the drillpipe element in place. The box end is typically positioned facing upward ("box up") such that the pin end of subsequently inserted drillpipe with the pin facing downward ("pin down") can be coupled with the box end of the previously inserted drillpipe or stump to continue formation of the downhole string. Drillpipe being added may be gripped at a distal end by a pipe drive system and the opposite distal end may be stabbed into the box end of the stump. Next, the pipe drive system may be employed to make-up a coupling between the drillpipe being added and the stump. Once the newly added drillpipe is appropriately attached, the gripping member may be removed and the drill string lowered further into the wellbore using an elevator. This process continues until a desired length of the drill string is achieved. Similarly, a reverse process may be used during removal of a drill string from a wellbore.

During a process of installing or removing drillpipe elements, it may be desirable to circulate fluids (e.g., drilling mud) through the associated drill string. However, present embodiments may include gripping an outer portion of the drillpipe with the drillpipe handling equipment rather than attaching a sub via threaded engagement. For example, in accordance with present embodiments, an upper distal end of a drillpipe element being added may be gripped around its outer perimeter with drillpipe handling equipment without making-up an extension of the drillpipe handling equipment to threads of the distal end such that more rapid positioning of the drillpipe element is facilitated. This may result in an inability to flow fluids from the drillpipe handling system through the drillpipe element being added or the drill string during connection, disconnection, removal, or insertion phases of the process. Indeed, without an appropriately sealed connection between the drillpipe element and drillpipe handling equipment, at least a portion of the fluid proceeding through the drillpipe handling equipment will seek a path of least resistance and flow around the drillpipe element rather than through it. Thus, present embodiments include features to enable proper circulation of fluids during certain portions of the process. Indeed, present embodiments are directed to providing a seal between the drillpipe handling equipment and the drillpipe element such that fluid can efficiently pass from the pipe drive system into the drillpipe element.

Turning now to the drawings, FIG. 1 is a schematic of a drilling rig 10 in the process of drilling a well in accordance with present techniques. While FIG. 1 represents a drilling process, present embodiments may be utilized for disassembly processes and so forth. In particular, present embodiments may be employed in procedures including assembly or disassembly of drillpipe elements, wherein it is desirable to provide an amount of fluid circulation through the drillpipe elements from a drillpipe handling system during assembly or disassembly procedures. Furthermore, present embodiments may be used to provide fluid circulation for removing cuttings during drilling of the earth formation and for controlling the well.

In the illustrated embodiment, the drilling rig 10 features an elevated rig floor 12 and a derrick 14 extending above the rig floor 12. A supply reel 16 supplies drilling line 18 to a crown block 20 and traveling block 22 configured to hoist various types of equipment and drillpipe above the rig floor 12. The drilling line 18 is secured to a deadline tiedown anchor 24. Further, a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another drillpipe element or length of drillpipe 38 is in the process of being added.

The length of drillpipe 38 is held in place by a pipe drive system 40 that is hanging from the drawworks 26. Specifically, a gripping device 42 of the pipe drive system 40 is engaged about an outer perimeter of a distal end 44 of the drillpipe 38. This attachment via the gripping device 42 enables the pipe drive system 40 to maneuver the drillpipe 38. In the illustrated embodiment, the pipe drive system 40 is holding the drillpipe 38 in alignment with the stump 36. As will be discussed below, the gripping device 42 includes an integral seal or is configured to couple with the drillpipe 38 about a seal such that a sealed passage is established between the pipe drive system 40 and the drillpipe 38. Establishing this sealed passage facilitates circulation of fluid (e.g., drilling mud) through the pipe drive system 40 into the drillpipe 38 and the drill string 28. Further, the gripping device 42 couples with the drillpipe 38 in a manner that enables translation of motion to the drillpipe 38. Indeed, in the illustrated embodiment the pipe drive system 40 includes a top drive 46 configured to supply torque for making-up and unmaking a coupling between the drillpipe 38 and the stump 36. It should be noted that, in some embodiments, the top drive 46 is separate from the pipe drive system 40.

Figure 2:
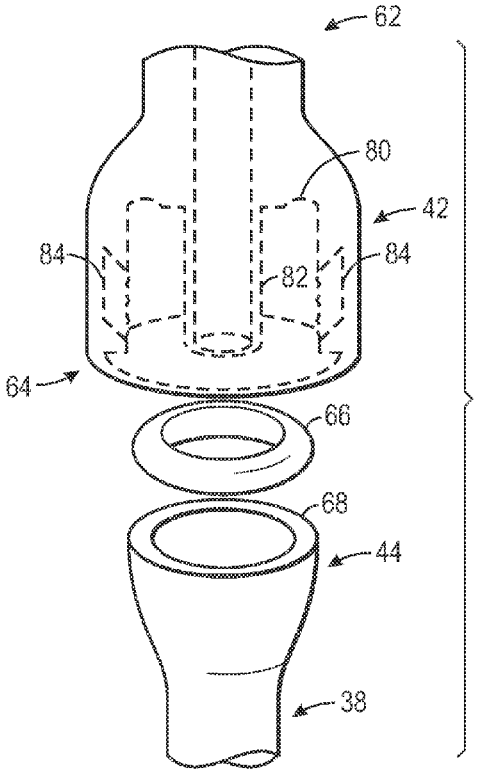
FIG. 2 is an exploded perspective view of a coupling between a gripping device and a drillpipe element in accordance with present techniques.

FIG. 2 is an exploded perspective view of a coupling between the gripping device 42 and the drillpipe 38 in accordance with present embodiments. Further, FIG. 2 illustrates a cross-sectional representation of certain internal components of the gripping device 42. Specifically, in accordance with the illustrated embodiment, the gripping device 42 includes a base end 62 and a drillpipe engagement end 64. The base end 62 may be integral with the pipe drive system 40 or it may include coupling features for attachment to the pipe drive system 40. The drillpipe engagement end 64 is configured to engage the distal end 44 of the drillpipe 38 such that a seal 66 is pressed between the gripping device 42 and a face 68 of the drillpipe 38 to create a sealed passage.

In the illustrated embodiment, the seal 66 is separate from the gripping device 42 and is held in position by the engagement of the gripping device 42 with the drillpipe 38. For example, the seal 66 may be designed to be disposable such that a new seal 66 may be utilized each time a different drillpipe 38 is coupled with the gripping device 42 or after a certain number of uses. Indeed, after one or more uses, the structure of the seal 66 and the material forming the seal 66 may become degraded such that the seal 66 ceases to function properly. In this case, an operator can simply obtain another disposable seal 66 and position it on the face 68 of the drillpipe 38 before lowering the gripping device 42 over the drillpipe 38. Facilitating frequent replacement of the seal 66 by employing disposable seals 66 substantially limits the functional requirements of the seal 66 in accordance with present techniques. In other embodiments, the seal 66 may be coupled directly to the gripping device 42 via adhesive, installment in a receptacle (e.g., a groove), or the like. Indeed, in some embodiments, the seal 66 may be imbedded or integral with the gripping device 42. For example, the seal 66 may be integrated with the gripping device 42 such that the gripping device 42 must be replaced when the seal is no longer functional. In embodiments wherein the seal is integrated with or embedded within the gripping device 42, the seal 66 may be designed to withstand long-term use. As an example, whether separate from or integral with the gripping device 42, the seal 66 may be formed from nitrile rubber and may be designed to withstand pressures ranging from 1,000 psi to 6,000 psi on the surface area of the seal 66.

Internal features of the gripping device 42 include a device face 80, a filler neck 82 extending from the device face 80, and engagement features 84. The device face 80 of the gripping device 42 is configured to abut the seal 66 such that the seal 66 is pressed between the device face 80 and the drillpipe face 68 of the distal end 44 of the drillpipe 38 when the gripping device 42 is properly coupled with the drillpipe 38. Such a coupling may be achieved by aligning the device face 80, the seal 66, and the drillpipe face 68 and then setting the gripping device 42 down on top of the drillpipe seal 66 and drillpipe 38. The weight of the pipe drive system 40, which may include the weight of the top drive 46 may assist in creating a 1,000 to 6,000 pound seal. In some situations, even higher seal pressure may be achieved. Indeed, the top drive 46 alone may weigh as much as 15 tons or more. As will be discussed below, once established, this seal may be maintained by coupling the gripping device 42 to the drillpipe 38 via the engagement features 84. Further, the activated seal may prevent flow of fluids outside of the drillpipe 38 and across other features of the gripping device 42, such as the engagement features 84, which can be degraded quickly by fluids used for circulation.

After or during establishment of such a compressive seal, the engagement features 84 (e.g., frictional engagement slips) may be actuated to maintain the coupling between the gripping device 42 and the drillpipe 38. For example, the engagement features 84 may be hydraulically, mechanically, electronically or otherwise actuated to radially engage a circumferential area of the drillpipe 38 by a control feature or the engagement features 84 may be automatically actuated in a radial direction based on the downward force applied by setting the gripping device 42 down on the seal 66 and the drillpipe face 68. Indeed, various mechanisms may be utilized to facilitate a frictional coupling between the outer circumferential area of the drillpipe 38 and the engagement features 84. The engagement features 84 generally include a textured surface that facilitates frictional engagement with the drillpipe 38 such that the gripping device 42 can be utilized to lift the drillpipe 38 and such that rotational movement is readily translated from the gripping device 42 to the drillpipe 38. Those having ordinary skill in the art will appreciate that the sealing features in accordance with present embodiments are independent of the manner in which the gripping of the drill pipe 38 is actuated and achieved.

Further, the process of coupling the gripping device 42 with the drillpipe 38 includes slidably positioning the filler neck 82 within the drillpipe 38. The filler neck 82 is sufficiently sized to fit within the inside diameter of one or more different types of drillpipe. Due to the shape and positioning of the filler neck 82 with respect to the gripping device 42, this engagement occurs as a result of positioning the gripping device 42 over the drillpipe 38. Indeed, the filler neck 82 may essentially guide such an engagement by extending into the drillpipe 38. Although shown as cylindrical, the filler neck 82 may be conical or otherwise shaped to avoid hanging up on the threads 118. Thus, a flow path extending through the pipe drive system 40 is extended into the drillpipe 38 via the filler neck 82, which facilitates fluid circulation from the pipe drive system 40 into the drillpipe 38 and any coupled drill string. In some embodiments, the filler neck 82 may be excluded. However, it may be beneficial to include the filler neck 82 for reducing back flow and resisting the washing of fluid across the connection. That is, the filler neck 82 may function to reduce wear or washout of the seal 66 and other features of the system. For example, it may be desirable for the filler neck 82 to be of sufficient length to extend past the threads of the distal end 44 of the drillpipe 38 to reduce wear on the threads, reduce wear on the seal 66, and generally encourage flow into the drillpipe 38 and any associated drill string.

Figure 3:
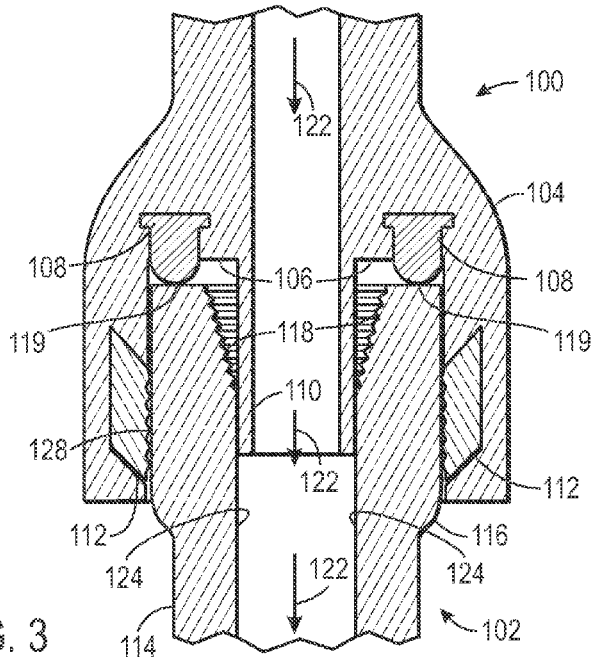
FIG. 3 is a schematic cross-sectional view of a gripping device with an integral seal and a drillpipe element in accordance with present techniques.

FIG. 3 is a schematic cross-sectional view of a gripping device 100 in the process of being coupled with a drillpipe element 102 in accordance with embodiments of the present technique. In the illustrated embodiment, the gripping device 100 includes a housing 104, a coupling device or housing face 106, an integral seal 108, a filler neck 110, and engagement pads 112 (also known in the art as "slips"). The drillpipe element 102 includes a drillpipe body 114, a tool joint 116, threads 118, and a drillpipe face 119.

Specifically, the arrangement of the gripping device 100 and the drillpipe element 102 illustrated by FIG. 3 represents the gripping device 100 being set down on the drillpipe element 102 such that, as generally discussed above, pressure or force (e.g., the weight of a top drive or pipe drive system) is applied to the integral seal 108 via the gripping device 100 and the drillpipe element 102. This force or pressure causes deformation of the integral seal 108 and establishment of a pressurized seal in a seal area between a flow path 122 through the gripping device 100 and drillpipe element 102, and areas outside of the flow path 122.

The flow path 122 includes the filler neck 110, which extends into the drillpipe element 102. While embodiments in accordance with the present techniques may not include such a feature, the illustrated embodiment includes the filler neck 110 to direct fluid flow past the threads 118 of the drillpipe element 102 and past the integral seal 108. Indeed, when fully inserted, the filler neck 110 is of sufficient length to extend past the integral seal 108 and past the threads 118 to limit interaction of circulation fluid with these components. Further, the filler neck 110 is sized such that it has limited clearance between the walls of the 124 drillpipe element 102, which creates resistance to back flow of the fluid towards the threads 118 and integral seal 108. The inclusion and sizing of the filler neck 110 will thus resist degradation of features of the gripping device 100 and drillpipe element 102 due to washout and so forth.

In the illustrated embodiment, the engagement pads 112 have not yet engaged with the outer circumferential area of the drillpipe element 102. However, once the pressurized seal is established to a desired degree, the engagement pads 112 may be actuated to radially engage an exterior of the drillpipe element 102. In some embodiments, the engagement pads 112 may be radially actuated by pushing them up or down with respect to an axis of the gripping device 100 such that they slide along a ramp that presses the engagement pads 112 radially inward to engage the drillpipe element 102. This actuation may be achieved in various manners, such as hydraulically or based on frictional engagement with the drillpipe element 102. For example, sliding the drillpipe element 102 between the engagement pads 112 may cause the engagement pads 112 to slide upwards against a ramp that pushes the engagement pads 112 radially inward. In another embodiment, the engagement pads 112 may be pressed radially inward without any vertical sliding motion. Indeed, various different actuation techniques and engagement features may be utilized in accordance with present embodiments.

In the illustrated embodiment, patterns 128 on the surface of the engagement pads 112 are configured to function as wickers and may be pressed into contact with the outer circumferential area of the tool joint 116 to establish a frictional coupling between the gripping device 100 and the drillpipe element 102. The patterns 128 may be arranged to provide resistance to movement in multiple directions once engaged. For example, the patterns 128 may include upwardly angled teeth and teeth aligned with an axis of the drillpipe element 102 such that rotational and lifting motions are efficiently imparted to the drillpipe from the gripping device 100. In this way, force from a top drive coupled to the gripping device 100 can be utilized to lift or rotate the drillpipe 102 during an assembly or disassembly process.

Figure 4:
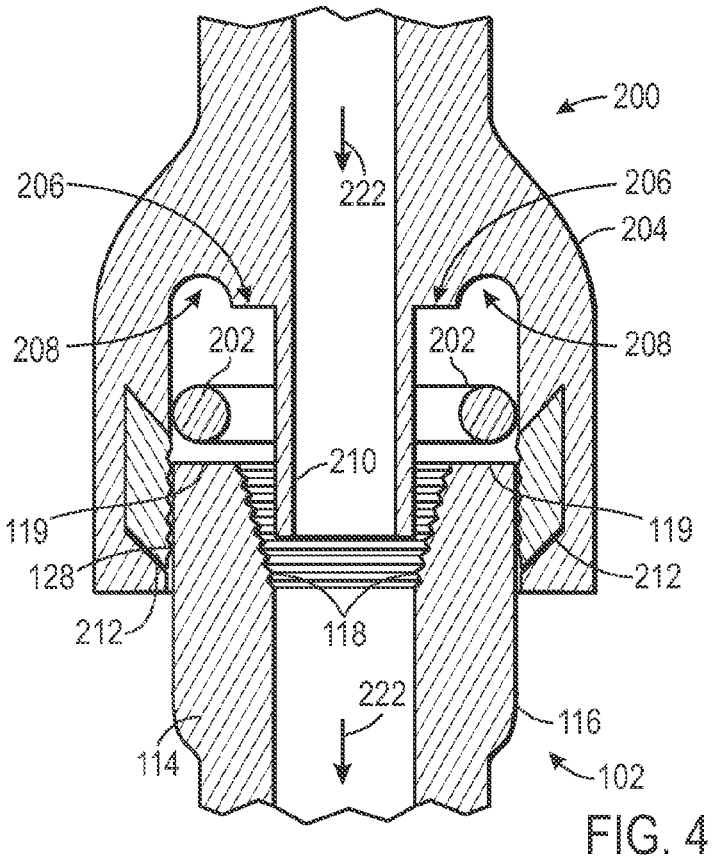
FIG. 4 is a schematic cross-sectional view of a gripping device, a separate seal, and a drillpipe element in accordance with present techniques.

FIG. 4 is a schematic cross-sectional view of a gripping device 200 in the process of being coupled with the drillpipe element 102 about a separate seal 202 in accordance with embodiments of the present technique. In the illustrated embodiment, the gripping device 200 includes a housing 204, a coupling device or housing face 206, a seal groove 208, a filler neck 210, and engagement pads 212. As discussed above, the drillpipe element 102 includes the drillpipe body 114, the tool joint 116, the threads 118, and the drillpipe face 119.

Specifically, the arrangement of the gripping device 200 and the drillpipe element 102 illustrated by FIG. 4 represents the gripping device 200 being set down on the drillpipe element 102 after the separate seal 202 has been positioned on the drillpipe face 119. As generally discussed above, once the separate seal 202 is abutting the housing face 206 and the drillpipe face 119 within a seal area, pressure or force (e.g., the weight of a top drive or pipe drive system) may be applied to cause deformation of the separate seal 202. Thus, the separate seal 202 is utilized to establish a pressurized seal between a flow path 222 through the gripping device 200 and drillpipe element 102, and areas outside of the flow path 222.

In the illustrated embodiment, the housing face 206 includes the seal groove 208, which is formed to provide a receptacle for the separate seal 202. In the illustrated embodiment, the separate seal 202 has been positioned on the drillpipe face 119 such that when it engages with the housing face 206, the separate seal 202 will be pressed into the seal groove 208. In other situations, the separate seal 202 may be initially installed within the seal groove 208 before coupling the gripping device 202 with the drillpipe element 102. Including a receptacle such as the seal groove 208 may stabilize the separate seal 202 and provide additional seal integrity. However, in some embodiments, the housing face 206 may not include the seal groove 208 or any type of receptacle for the separate seal 208. Rather, in some embodiments, the housing face 206 may be substantially flat and/or textured for engagement with the separate seal 202 such that it can be pressed between the housing face 206 and the drillpipe face 119.

Other aspects of the gripping device 200 illustrated in FIG. 4 are similar to those of the gripping device 100 illustrated in FIG. 3. For example, when the flow path 222 is established by coupling the gripping device 200 with the drillpipe element 102, the flow path 222 includes the filler neck 210, which extends into the drillpipe element 102. Further, as with the embodiment illustrated in FIG. 3, the engagement pads 212 illustrated in FIG. 4 have not yet engaged with the outer circumferential area of the drillpipe element 102. However, once the pressurized seal is established to a desired degree, the engagement pads 112 may be actuated to radially engage an exterior of the drillpipe element 102 such that patterns or wickers 228 of the engagement pads 112 frictionally grip the drillpipe element 102, or more specifically the tool joint 116 portion of the drill pipe element 102.

Figure 5:
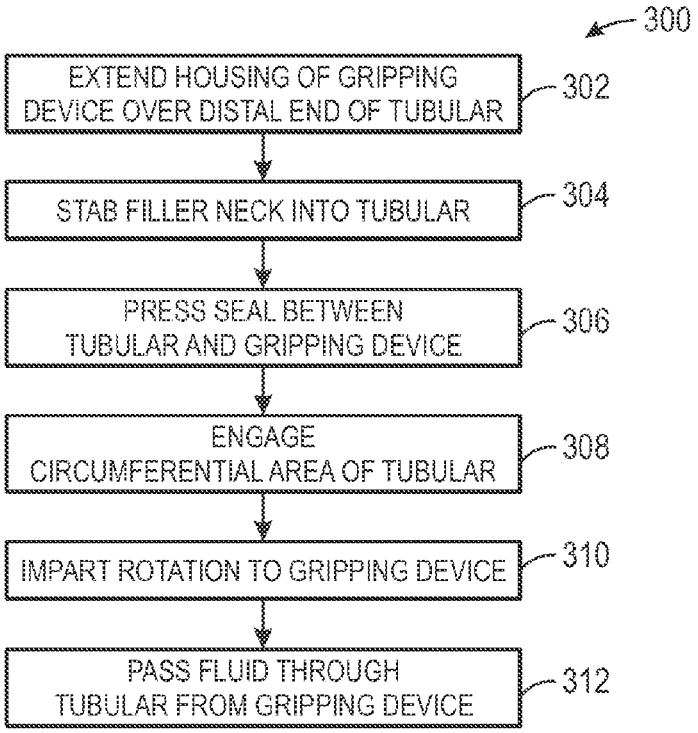
FIG. 5 is a process flow diagram of a method in accordance with present techniques.

FIG. 5 is a process flow diagram of a method of assembling or disassembling a drill string in accordance with present techniques. The method is generally indicated by reference numeral 300 and includes blocks that are representative of various steps or acts in the method 300. It should be noted that the various steps of the method 300 can be performed in the illustrated order or in a different order in accordance with present techniques. Further, in some instances, certain steps illustrated in FIG. 5 may be eliminated or additional steps may be performed.

As represented by block 302, the method 300 begins with extending a housing of a gripping device over a distal end of a drillpipe element such that a boundary of the housing extending from a perimeter of a face of the gripping device surrounds a circumferential area of the drillpipe element. As represented by block 304, this may result in stabbing a filler neck into the drillpipe element, wherein the filler neck extends from an inner perimeter of the face of the gripping device. Next, as represented by block 306, the method 300 includes pressing a seal between the face of the gripping device and a face of the drillpipe element. The seal may be integral with the gripping device or this may include the act of placing the seal between the gripping device and the drillpipe element. Further, block 308 represents engaging the circumferential area of the drillpipe element with an engagement feature of the gripping device. The step represented by block 308 may include hydraulically actuating gripping pads. Block 310 represents rotating the gripping device to impart rotation to the drillpipe element to facilitate attachment or detachment of the drillpipe element with a drill string. Further, block 312 represents passing fluid through the filler neck into the drill string.

Present embodiments may provide the advantages of a relatively simple, reliable, and inexpensive seal between the surface equipment on the drilling rig and a string of drill pipe without the need to make-up a threaded connection. In one embodiment, the seal could be an elastomeric ring, such as urethane, nitrile or butyl rubber, that is pressed between the sealing surface within the gripping device and the upward facing surface of the drill pipe. The seal's pressure capability is substantially dependent, if not proportional, to squeeze applied to the seal. The weight of the gripping device and other surface equipment, such as the top drive, is typically over 20,000 lbs., if not several times that weight. Most of the surface equipment weight can be applied towards squeezing the seal, which should easily withstand fluid pressures typical of drilling operations. This simplified, somewhat "brute force," method of sealing allows for wide dimensional and surface finish tolerances because the squeezed seal will simply form itself to the surfaces between which the seal is squeezed. The ability to seal against surface imperfections is useful because the drill pipe is handled roughly during drilling operations, which leads to gouges and scratches on the face of the tool joint. Because the simple shapes (e.g., cylindrical or O-ring) and relatively cheap elastomers that may be used for the seal, the seals may even be treated as disposable without adding significantly to the costs of the drilling operation.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A pipe drive system, comprising:

a gripping device configured to engage an outer surface of a drillpipe element to be positioned within a wellbore;

a top drive configured to impart rotational force to the gripping device;

a housing of the gripping device configured to extend over and at least partially around a distal end of the drillpipe element;

a seal area positioned along an inner perimeter of the housing such that, when a seal is inserted in the seal area, the seal is arranged to axially abut and engage with an axial face of the distal end of the drillpipe element and an axial face of the gripping device relative to a longitudinal axis of the gripping device; and engagement features of the gripping device configured to extend inwardly from the inner perimeter to facilitate coupling of the gripping device with an outer circumferential area of the drillpipe element.

2. The system of claim 1, comprising the seal, wherein the seal is coupled to the axial face of the gripping device via a friction fit or via adhesive.

3. The system of claim 1, comprising the drillpipe element and the seal, wherein the seal is removably positioned and pressed between the axial face of the distal end of the drillpipe element and the axial face of the gripping device.

4. The system of claim 1, wherein the seal area includes a receptacle in the axial face of the gripping device.

5. The system of claim 1, comprising the seal, wherein a pressure sealed by the seal is proportional to a force applied to the seal between the seal area and the axial face of the distal end of the drillpipe element.

6. The system of claim 1, comprising the seal and a filler neck, wherein the filler neck is configured to extend into the drillpipe element when the distal end of the drillpipe element is disposed within the gripping device such that the seal is pressed between the axial face of the distal end of the drillpipe element and the axial face of the gripping device, wherein the filler neck includes a channel configured to facilitate fluid flow into the drillpipe element from a fluid pump.

7. The system of claim 6, wherein the filler neck is sized to extend past threads of the distal end of the drillpipe element when the distal end of the drillpipe element is disposed within the gripping device such that the seal is pressed between the axial face of the distal end of the drillpipe element and the axial face of the gripping device.

8. The system of claim 1, wherein the engagement features comprise pads configured to frictionally engage the outer circumferential area of the drillpipe element.

9. The system of claim 8, wherein the pads include patterns configured to function as wickers for frictionally engaging the outer circumferential area of the drillpipe element.

10. A gripping device, comprising:

a housing including a receptacle, wherein the receptacle includes an axial receptacle face and a receptacle boundary extending from a perimeter of the axial receptacle face;

an engagement feature coupled with the housing and configured to be actuated to engage an outer circumferential area of a drillpipe element to be positioned within a wellbore when the housing is extending over a distal end of the drillpipe element; and a seal positioned within an inner boundary of the housing, wherein the seal is arranged to engage with an axial drillpipe face of the distal end of the drillpipe element and the axial receptacle face within the housing relative to a longitudinal axis of the gripping device.

11. The gripping device of claim 10, comprising a filler neck configured to extend into the drillpipe element when the distal end of the drillpipe element is disposed within the housing such that the seal is pressed between the axial receptacle face and the axial drillpipe face, wherein the filler neck includes a channel configured to facilitate fluid flow into the drillpipe element.

12. The gripping device of claim 11, wherein the filler neck is sized to extend past threads of the distal end of the drillpipe element when the distal end of the drillpipe element is disposed within the housing such that the seal is pressed between the axial receptacle face and the axial drillpipe face.

13. The gripping device of claim 10, comprising a coupling mechanism configured to facilitate coupling of the gripping device with a pipe drive system such that the pipe drive system can impart motion to the gripping device.

14. The gripping device of claim 10, wherein the engagement feature comprises a plurality of pads with patterned gripping surfaces to facilitate frictional engagement with the outer circumference of the drillpipe element.

15. The gripping device of claim 10, wherein the axial receptacle face comprises a groove shaped recess to receive the seal.

16. A method of assembling or disassembling a drill string, comprising:

extending a housing of a gripping device over a distal end of a drillpipe element to be positioned within a wellbore such that a boundary of the housing extending from a perimeter of an axial face of the gripping device surrounds a circumferential area of the drillpipe element;

pressing a seal between the axial face of the gripping device and an axial face of the drillpipe element relative to a longitudinal axis of the gripping device; and engaging the circumferential area of the drillpipe element with an engagement feature of the gripping device.

17. The method of claim 16, wherein engaging the circumferential area comprises engaging gripping pads of the gripping device with the circumferential area of the drillpipe element.

18. The method of claim 16, comprising stabbing a filler neck that extends from an inner perimeter of the axial face of the gripping device into the drillpipe element.

19. The method of claim 18, comprising rotating the gripping device to impart rotation to the drillpipe element to facilitate attachment or detachment of the drillpipe element with a drill string while passing fluid through the filler neck into the drill string.

20. The method of claim 18, comprising retaining the seal against the axial face of the gripping device with a fastener.

* * * * *